United States Patent [19]

Poirier et al.

[11] Patent Number: 4,724,810

[45] Date of Patent: Feb. 16, 1988

[54] ENGINE IDLE SPEED CONTROL WITH FEEDFORWARD POWER ADJUSTMENT

[75] Inventors: David C. Poirier, Troy; Grant W. Brady, Redford; Robert C. Simon, Novi; Janet M. Koch, Plymouth; Peter M. Medich, Garden City; Richard A. Marsh, Beverly Hills, all of Mich.

[73] Assignee: General Motors Corporation, Detroit, Mich.

[21] Appl. No.: 14,581

[22] Filed: Feb. 13, 1987

[51] Int. Cl.[4] ..... F02M 3/07

[52] U.S. Cl. ..... 123/339; 180/69.3

[58] Field of Search ..... 123/339, 340; 180/141, 180/142, 69.3

[56] References Cited

U.S. PATENT DOCUMENTS

| | | | |
|---|---|---|---|
| 3,022,849 | 2/1962 | Braun | 180/69.3 |
| 3,146,844 | 9/1964 | Carlson | 180/69.3 |
| 3,146,845 | 9/1964 | Carlson | 180/69.3 |
| 4,225,003 | 9/1980 | Yoshimura | 180/69.3 |
| 4,321,900 | 3/1982 | Takeda | 123/339 |
| 4,520,777 | 6/1985 | Hatori et al. | 123/339 |
| 4,545,449 | 10/1985 | Fujiwara | 180/69.3 |

FOREIGN PATENT DOCUMENTS

| | | | |
|---|---|---|---|
| 2908245 | 10/1979 | Fed. Rep. of Germany | 123/339 |
| 0053328 | 4/1977 | Japan | 180/69.3 |
| 0008330 | 1/1982 | Japan | 123/339 |
| 0016229 | 1/1982 | Japan | 123/339 |
| 0026231 | 2/1982 | Japan | 123/339 |

*Primary Examiner*—Willis R. Wolfe

*Attorney, Agent, or Firm*—Mark A. Navarre

[57] ABSTRACT

A feedforward throttle adjustment for a closed loop idle speed control provides engine power output required to drive a variable power steering load while maintaining the engine idle speed in a desired range. The working pressure of the power steering system is detected, and the change in such pressure in the course of a steering maneuver is used to initiate an increase in the engine power output setting. The increase is determined in relation to the peak pressure change; it is implemented at a pedetermined rate, and is subject to interruption whenever the pressure change indicates that the steering maneuver has ended.

10 Claims, 15 Drawing Figures

ENGINE IDLE SPEED CONTROL WITH FEEDFORWARD POWER ADJUSTMENT

Figure 1:
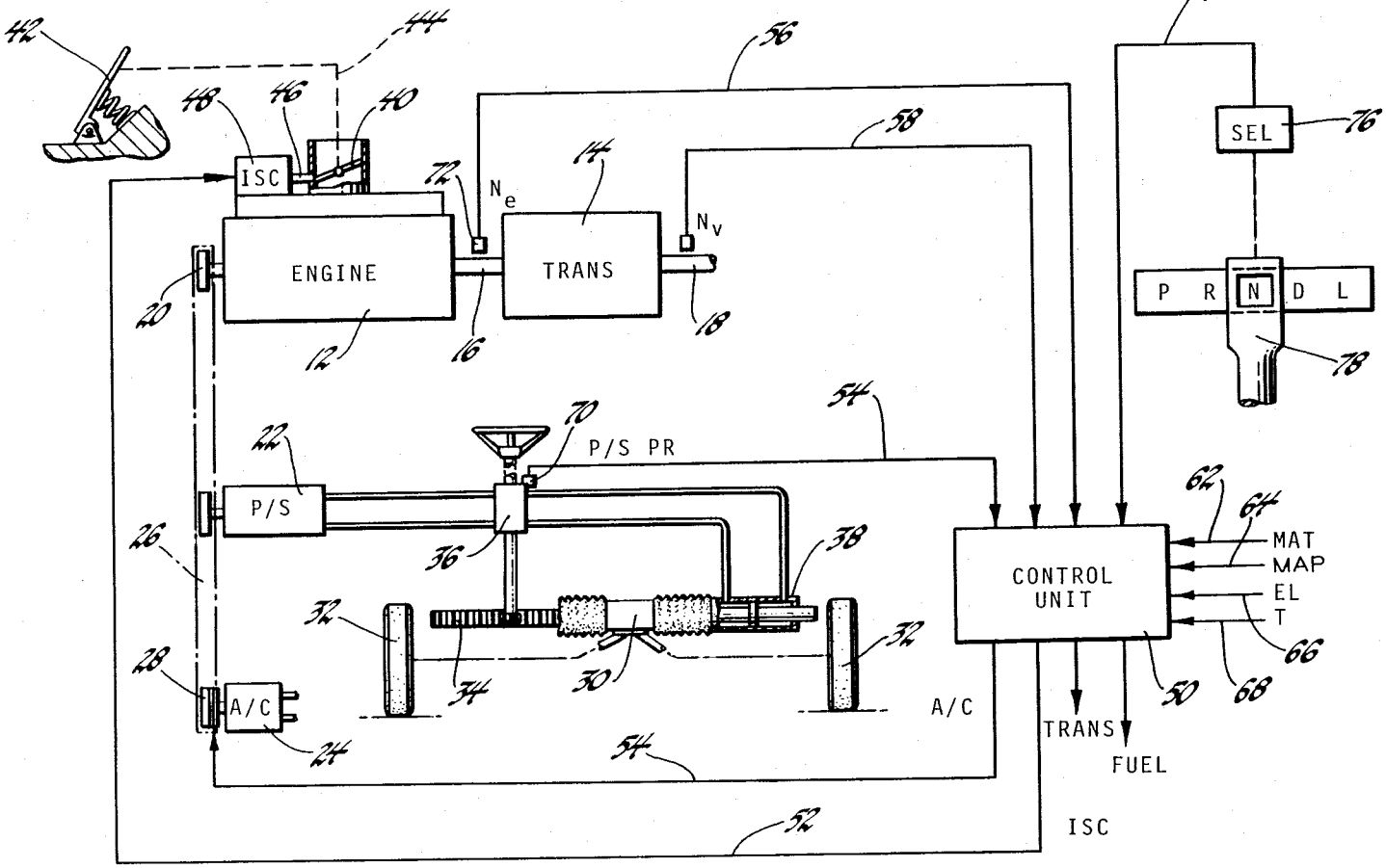

This invention relates to the control of engine idle speed in motor vehicles having an engine which supplies the input power requirement of a power assist steering system and more particularly to a feedforward adjustment of the engine output power in response to changes in the input power requirement of the steering system.

In state of the art automotive engine controllers, the throttle position or intake air is actively regulated at idle to maintain the engine speed within a desired range. On one hand, the controller must increase the engine power output to prevent engine stalling due to increased loading. This control may become especially sensitive in tuned port fuel injected engines with large intake manifold volumes due to the resulting lag in control signal inputs. On the other hand, the controller must decrease the engine power output to prevent engine speed flare due to decreased loading. This control directly affects drivability since speed flare is discernible to the driver in the form of excessive creep.

State of the art idle speed controllers typically operate closed loop on measured engine speed. That is, the idle speed is adjusted in relation to a comparison of the measured idle speed and a reference parameter indicative of the desired idle speed. The response or gain of such controllers is relatively slow due to the lag between the throttle/air adjustment and the desired increase or decrease in engine power output. A common expedient is to anticipate loading changes and delay the change until the controller can effect the required change in engine power output. This technique applies, for example, to air conditioning compressor loading and transmission gear selection. However, certain changes in engine loading are difficult to anticipate and/or undesirable to delay. In the case of an engine driven power steering pump, the changes in load can not be anticipated with sufficient lead time.

For the above reasons, it is common practice in current automotive engine idle speed controllers to effect open-loop or feedforward correction of the idle speed in response to a sensed increase in the hydraulic pressure of the power steering system. For example, certain production engine controllers increase the engine throttle setting at idle by a predetermined increment if the power steering pressure exceeds a reference threshold indicative of relatively high engine loading. This effects a relatively fast increase in the engine power output and, hopefully, prevents engine stalling. While such control works reasonably well in most applications, we have found that it is unacceptable in installations especially susceptible to engine stalling and/or where engine flare is especially objectionable.

Accordingly, the primary object of this invention is to provide a motor vehicle engine idle speed control having improved feedforward control of the engine power output setting in response to changes in power steering load at idle.

This object is carried forward by monitoring the working pressure of the power steering system and by increasing the engine throttle setting (positive feedforward adjustment) in relation to the change in such pressure whenever the power steering load is increasing. The pressure change is measured with respect to a floating reference (START PR) that is updated in response to a pressure decrease indicative of steady or decreased loading. In turn, the feedforward increase in engine power output is scheduled in relation to the peak pressure change detected during the steering maneuver. The control adjustment for achieving the increased engine power output is carried out at a variable rate and is interrupted if the pressure change indicates that the steering maneuver is over or becoming less severe. Removal or reduction of the feedforward adjustment is carried out either by the closed-loop idle speed control, or by the feedforward control (negative feedforward adjustment) in the case of rapid consecutive increases and decreases in the power steering loading.

The control also encompasses disablement of an engine driven air conditioning compressor as a function of the rate of increase in the power steering working pressure. If the compressor load is actually released, there is a load swap between the air conditioning system and the power steering system, and feedforward increases in the engine throttle setting may be inhibited.

With the control functions of this invention, the idle speed control problems associated with the inability to predict or schedule the power steering loading are overcome because the positive feedforward adjustments in engine power output are made in relation to the change in power steering loading, as opposed to absolute levels of loading. Overshoots are avoided because the adjustments are interrupted whenever the pressure change indicates that the steering maneuver is ending or becoming less severe. As a result, an idle speed control system according to this invention anticipates the power steering load and ensures that the engine will provide the correct amount of engine power output to maintain the engine idle speed within a desired range.

IN THE DRAWINGS

FIG. 1 is a schematic diagram of a motor vehicle drivetrain and accessory control system, including a computer based control unit for carrying out the control functions of this invention.

Figure 2:
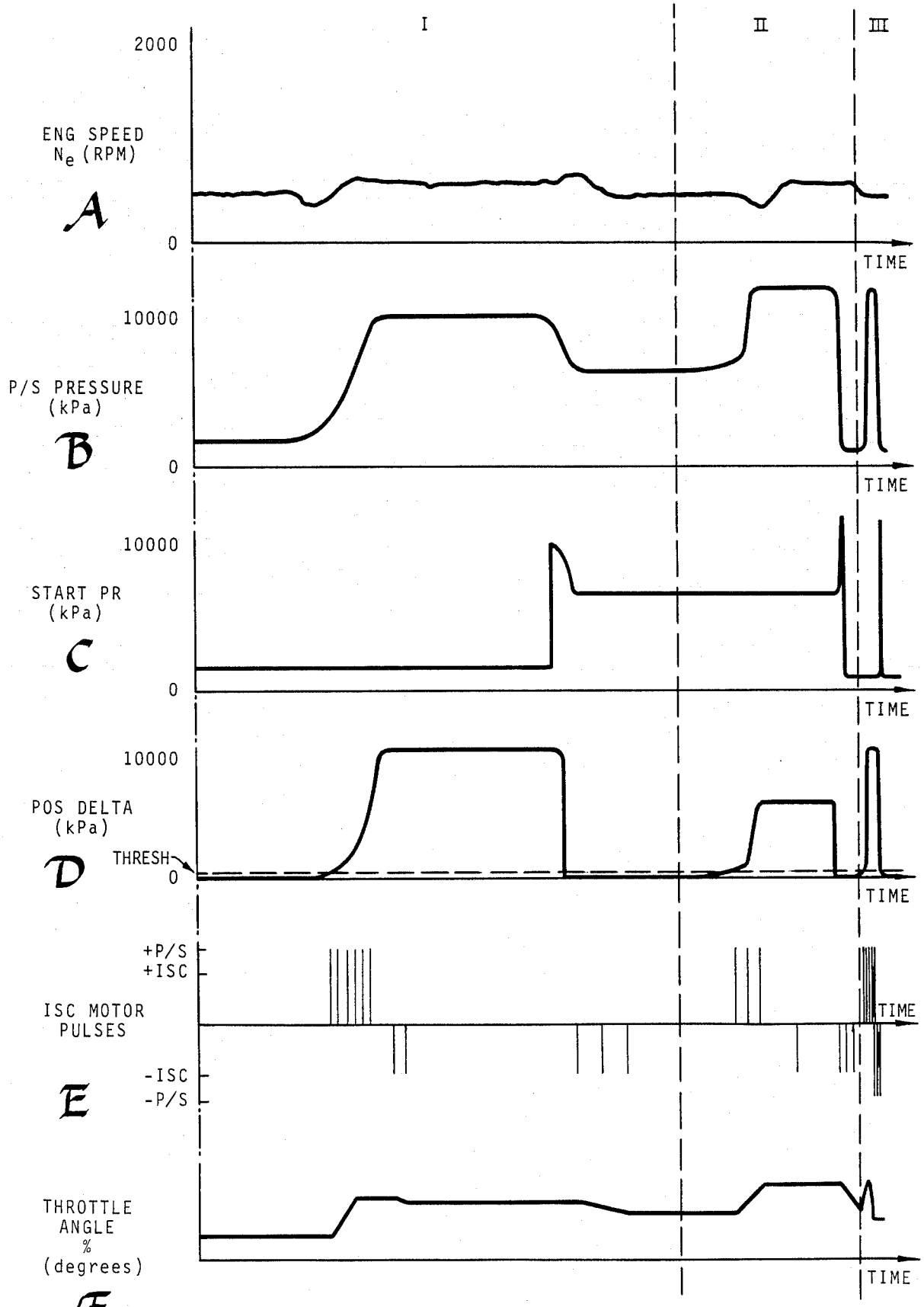

FIG. 2 includes Graphs A–F depicting the operation of this invention in the course of various steering maneuvers.

FIGS. 3–10 depict flow diagrams representative of computer program instructions executed by the control unit of FIG. 1 in carrying out the control functions of this invention.

Referring now to the drawings, and more particularly to FIG. 1, reference numeral 10 generally designates a motor vehicle drivetrain including an engine 12 and automatic transmission 14. The engine output shaft 16 drives the transmission 14, and the transmission output shaft 18 drives the vehicle wheels (not shown). Engine 12 also includes a rotating output pulley 20 for driving, among other things, a hydraulic power steering pump 22 and an air conditioning refrigerant compressor 24 via drive belt 26. The pump 22 is directly and continuously driven, whereas the compressor 24 is selectively driven through an electrically actuated clutch 28.

The pump 22 represents one component of a conventional power rack and pinion steering system, which further includes a steering shaft driven pinion 30 for transmitting operator exerted steering torque to the vehicle wheels 32 via rack 34, and a control valve 36 for directing the output of the pump 22 to a power assist cylinder 38 in relation to the level of the operator exerted torque. The power steering load reflected to the engine 12 varies in direct relation to the fluid pressure supplied to the power cylinder 38 by the control valve 36. This pressure is referred to herein as the working pressure of the power steering system.

The engine power output for driving the vehicle, the pump 22, the compressor 24 and other engine driven loads, is adjusted primarily by the operator of the vehicle who positions an engine throttle 40 via an accelerator pedal 42 and linkage 44. Increasing (opening) the throttle setting effects an engine output power increase; decreasing (closing) the throttle setting effects an engine output power reduction.

When the operator releases the accelerator pedal 42, a throttle return spring (not shown) closes the throttle 40 until it engages the armature 46 of idle speed control motor (ISC) 48. In effect, the armature 46 operates as a continuously variable stop for the throttle 40. Extension of the armature 46 increases the engine power at idle, and hence, the engine idle speed for a given load; retraction of the armature 46 decreases the engine power at idle, and hence, the engine idle speed for a given load.

Actuation of the ISC motor 48 and compressor clutch 28 is controlled by a computer-based control unit 50 via lines 52 and 54. Other functions including transmission shifting and engine fueling may also be controlled, as indicated in FIG. 1. In performing such control, input signals indicative of various operating parameters are supplied to control unit 50 via lines 54–68. The pressure signal on line 54 is obtained from a conventional pressure transducer 70; it corresponds to the working pressure of the steering system, and hence, the power steering load to engine 12. The engine and vehicle speed signals $N_e$ and $N_v$ on lines 56 and 58 are obtained with conventional speed pickups 72 and 74. The transmission selector (SEL) signal on line 60 is obtained with a conventional position transducer 76 and corresponds to the position of an operator manipulated shift selector 78. The designations P, R, N, D and L correspond to Park, Reverse, Neutral, Drive, and Low modes of transmission 14. The remaining input signals on lines 62–68 pertain to the engine manifold absolute temperature (MAT), the sensed altitude (ALT), the electrical loading (EL), and the engine coolant temperature (T), respectively, and are obtained using conventional transducer technology.

FIGS. 3–10 depict flow diagrams representative of the computer program instructions executed by the control unit 50 in carrying out the control functions of this invention.

Figure 3:
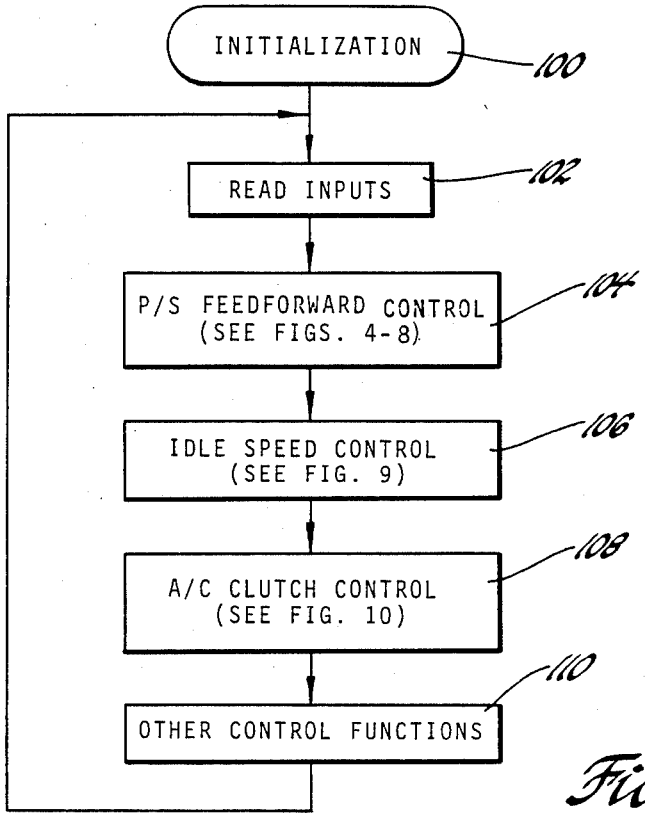

FIG. 3 designates an executive, or main loop program. The block 100 of FIG. 3 designates a series of instructions executed at the initiation of each period of vehicle operation for initializing the various registers, timers, etc., of the control unit 50 prior to the commencement of the control functions of this invention. The instructions represented by the block 102 cause the control unit 50 to read the various input signals described in reference to FIG. 1, and the instructions represented by the blocks 104–108 direct the execution of the various control functions. The control functions are broadly defined as POWER STEERING (P/S) FEEDFORWARD CONTROL, IDLE SPEED CONTROL, and AIR CONDITIONING (A/C) CLUTCH CONTROL. Other unspecified control functions may also be performed, as indicated by the block 110. The P/S FEEDFORWARD CONTROL routine is described below in reference to the flow diagrams of FIGS. 4–8, the IDLE SPEED CONTROL routine is described below in reference to the flow diagram of FIG. 9, and the A/C CLUTCH CONTROL routine is described below in reference to the flow diagram of FIG. 10. The control functions defined by the blocks 102–108 are sequentially and repeatedly executed as indicated by the flow diagram lines.

Figure 4:
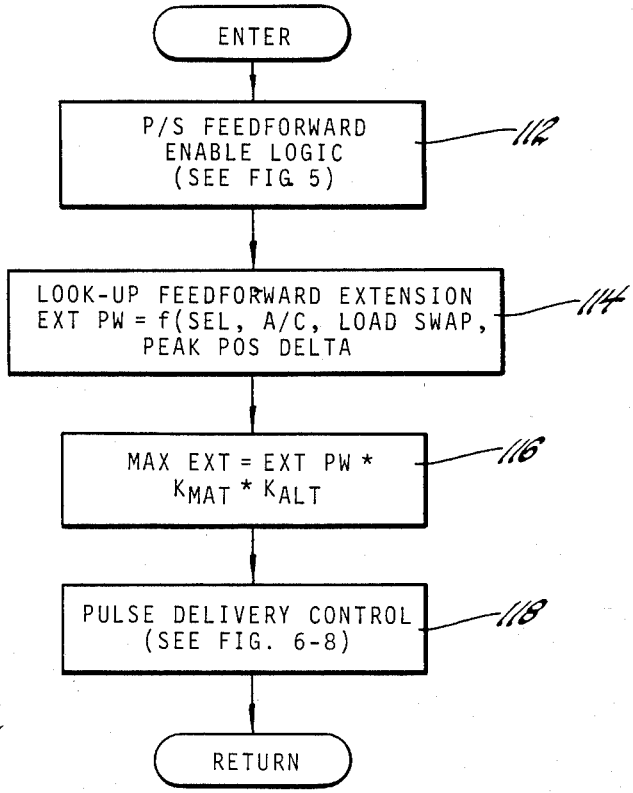

As seen in the flow diagram of FIG. 4, the P/S FEEDFORWARD CONTROL routine comprises three main steps: ENABLE LOGIC as indicated by the block 112, FEEDFORWARD COMPUTATION as indicated by the blocks 114–116, and PULSE DELIVERY CONTROL as indicated by the block 118.

Figure 5:
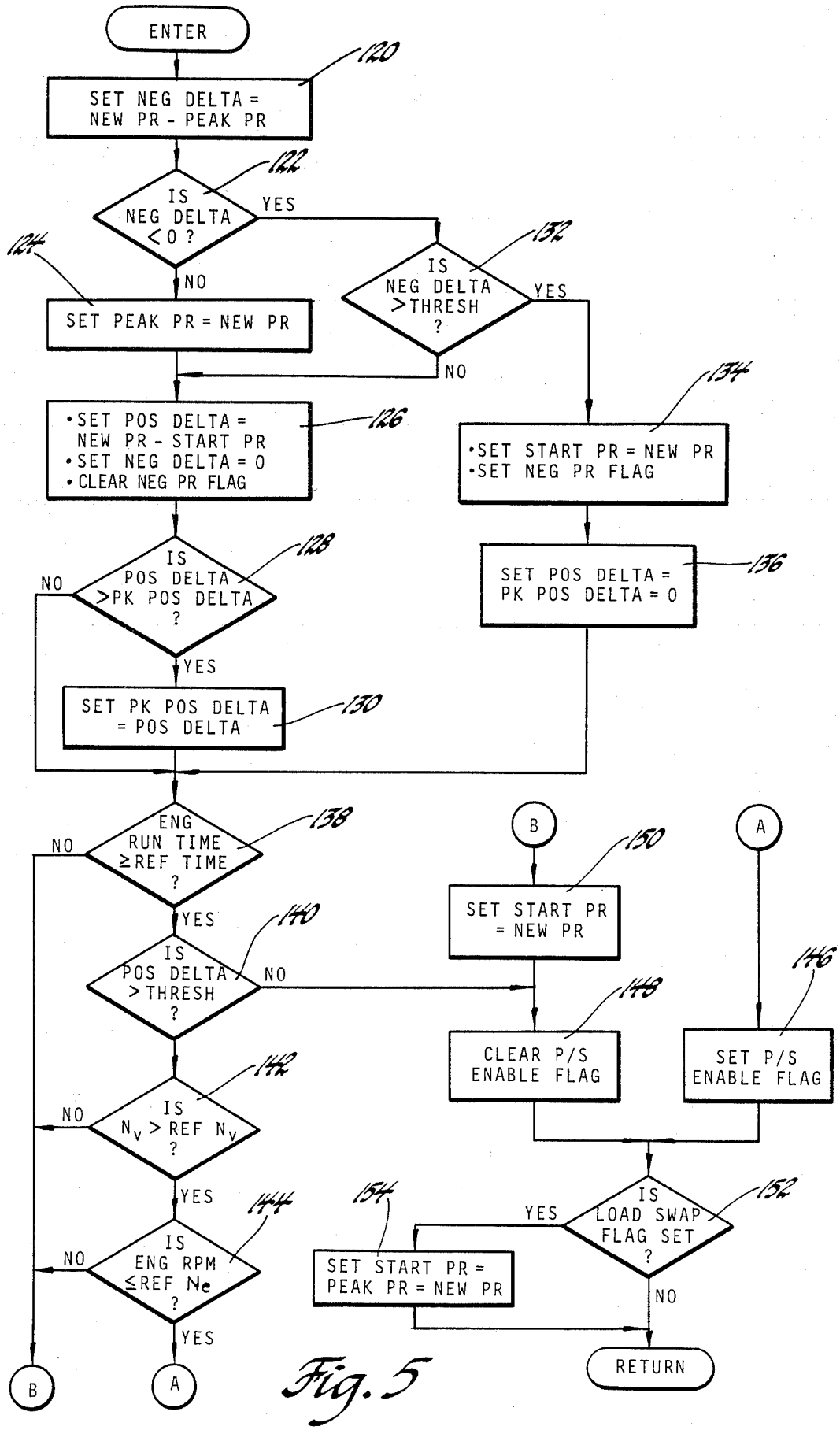

The ENABLE LOGIC step is set forth in detail in the flow diagram of FIG. 5. Referring to that Figure, the instructions represented by the blocks 120–136 evaluate the most recent measure of the power steering working pressure NEW PR relative to prior pressure values. The term PEAK PR represents the highest working pressure measured in the course of a given steering maneuver. The difference (NEW PR − PEAK PR) is designated by the term NEG DELTA. Thus, PEAK PR is set equal to NEW PR whenever NEG DELTA is negative, as indicated by the blocks 120–124.

Whenever the term NEG DELTA is negative, the power steering load is increasing. In such event, an increase in engine power output may be required to meet the increased load, and the blocks 126–130 are executed to evaluate the severity of the pressure increase. For bookkeeping purposes, the blocks 126–130 are also executed if NEG DELTA is positive but less than a relatively low threshold, THRESH, as indicated at the block 132.

In practice, a given steering maneuver often comprises a plurality of successive changes in the load reflected to the engine, the end of any one such change being accompanied by some reduction in the working pressure of the power steering system. At any point in a steering maneuver, the increase in working pressure, POS DELTA, is determined with respect to the working pressure, START PR, in effect at the initiation of the given load change. As indicated below in reference to the blocks 132–136, the term START PR is updated to NEW PR at each significant working pressure reduction. Thus, the pressure increase, POS DELTA, is defined as the difference (NEW PR − START PR), as indicated at the block 126. In addition, the term NEG DELTA is reset to zero, and the NEG PR FLAG is cleared to indicate that a pressure decrease in excess of THRESH has not occurred. The instructions represented by the blocks 128–130 define a term PK POS DELTA, as the greatest increase in working pressure since the updating of the term START PR. The term PK POS DELTA is used, as described below, to determine the maximum feedforward throttle extension value.

If there is a working pressure decrease in excess of the reference THRESH, the instruction blocks 134–136 are executed to set the term START PR equal to NEW PR, to reset the terms POS DELTA and PK POS DELTA to zero, and to set the NEG PR FLAG to indicate that a pressure decrease in excess of THRESH has occurred.

The blocks 138–144 define four conditions which must be met to enable positive feedforward adjustment (extension) of the throttle setting. If the engine has been running for at least a reference time REF TIME (block 138), the term POS DELTA is greater than the reference threshold THRESH (block 140), the vehicle speed $N_v$ is greater than a reference speed REF $N_v$ (block 142), and the engine speed $N_e$ is less than a reference speed REF $N_e$ (block 144), the block 146 is executed to set the P/S ENABLE FLAG. This indicates that feedforward throttle extensions are enabled. If any of the conditions are not met, the block 148 is executed to clear the P/S ENABLE FLAG, indicating that feedforward throttle extensions are not enabled. If the conditions defined by blocks 138, 142, or 144 are not met, the block 150 is additionally executed to update the term START PR to NEW PR.

If a load swap (A/C for P/S) has occurred, the terms START PR and PEAK PR are reset to NEW PR as indicated by the blocks 152–154. The significance of the load swap to the feedforward control is described below in reference to the A/C CLUTCH CONTROL routine of FIG. 10.

As indicated by the blocks 114–116 in FIG. 4, the maximum feedforward throttle extension MAX EXT is determined as a function of the peak delta pressure increase, PEAK POS DELTA, a manifold absolute temperature multiplier, $K_{MAT}$, and an altitude multiplier, $K_{ALT}$. Different tables of MAX EXT vs. PEAK POS DELTA are provided for the various combinations of transmission mode (P/N, D/R), air conditioning compressor status (A/C ON, A/C OFF), and LOAD SWAP status (ON, OFF). The MAX EXT values stored in the tables generally increase with increasing values of PK POS DELTA, but are empirically determined and calibrated for a given vehicle drivetrain for delivering optimal idle control.

Figure 6:
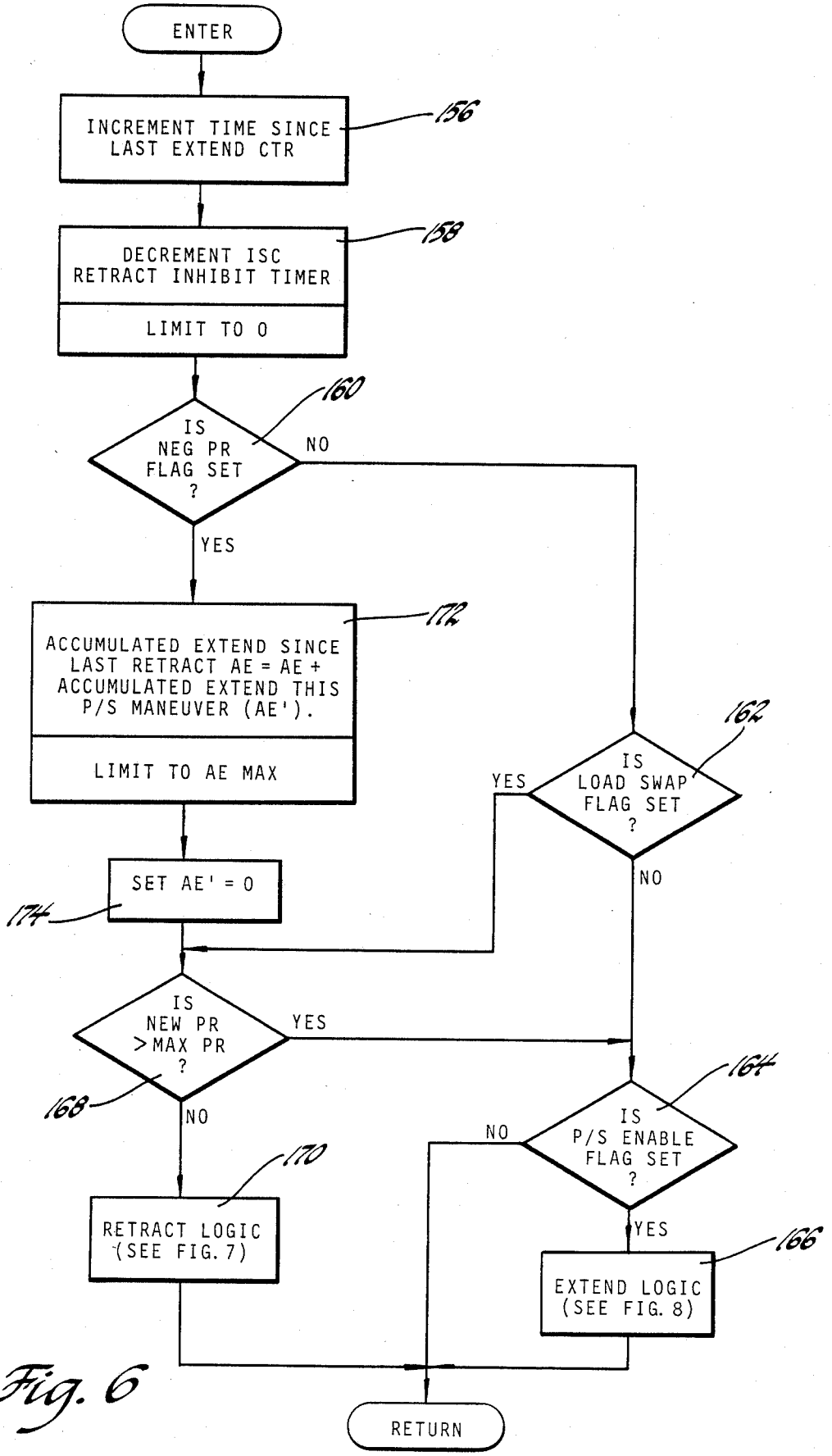
Figure 7:
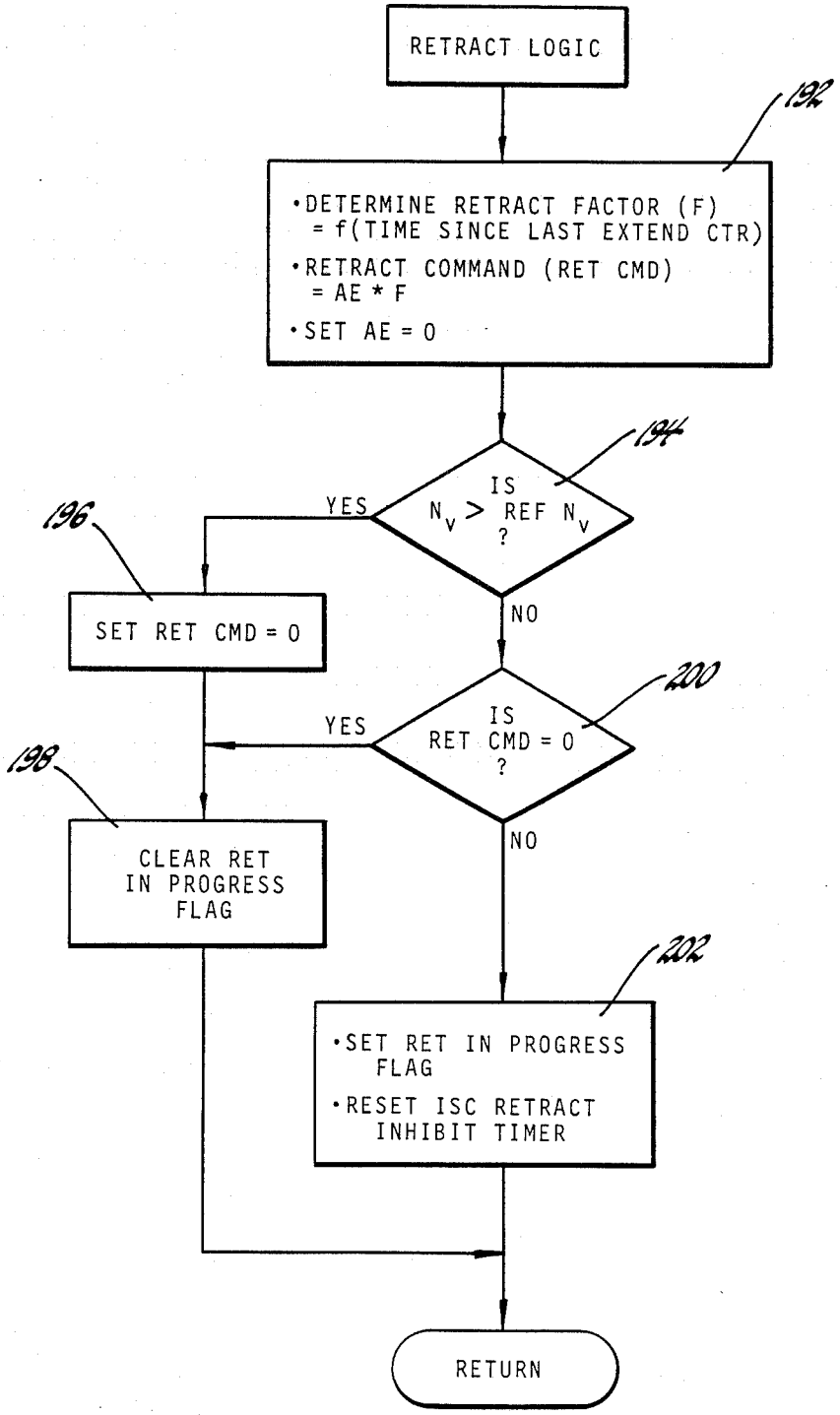
Figure 8:
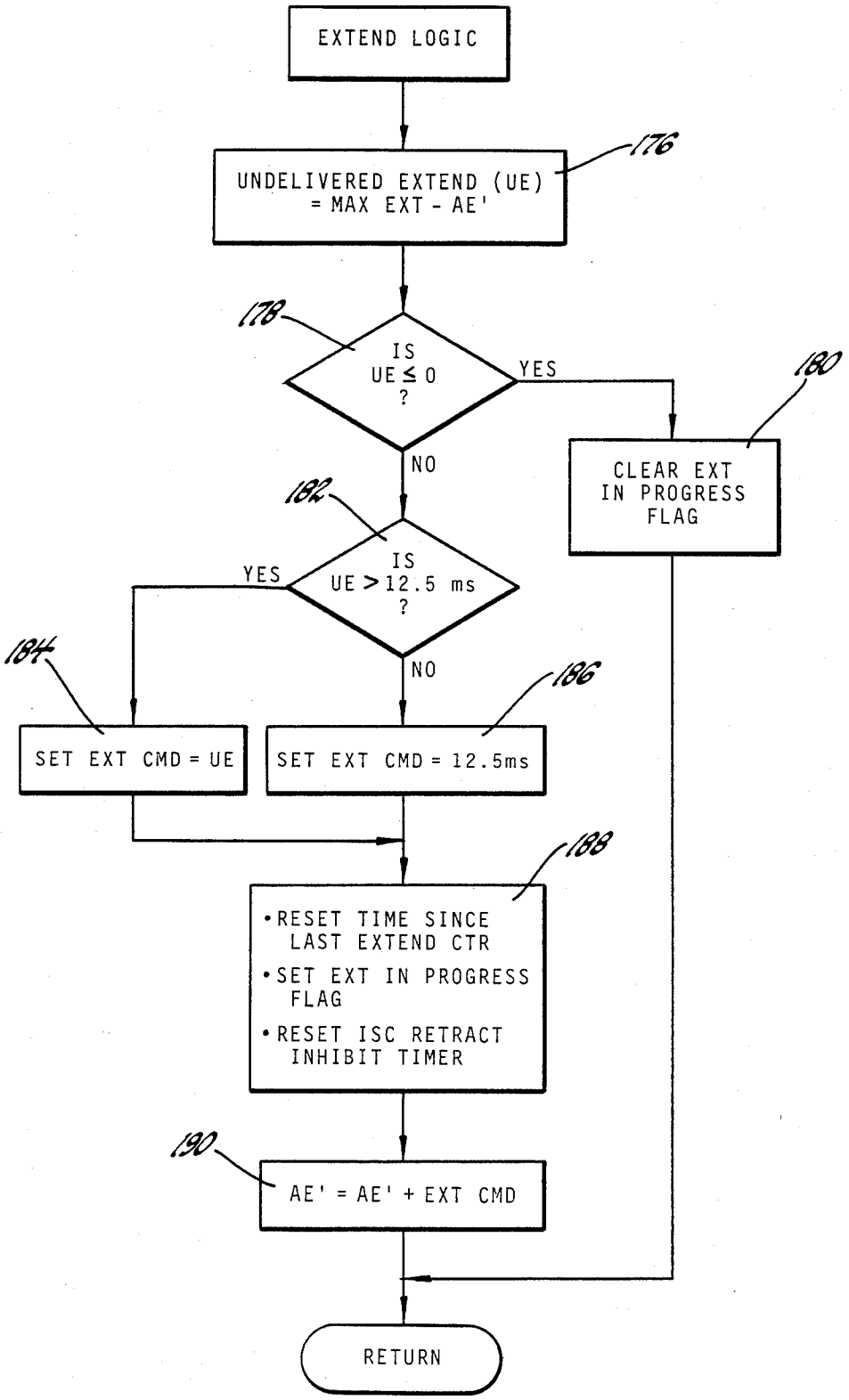

The PULSE DELIVERY CONTROL step is set forth in detail in the flow diagrams of FIGS. 6–8. Referring to FIG. 6, the blocks 156–158 perform timer bookkeeping functions. Block 156 increments the TIME SINCE LAST EXTEND CTR, and block 158 decrements the RETRACT INHIBIT TIMER, limiting the timer value to zero. The TIME SINCE LAST EXTEND CTR is used in the retraction or removal of feedforward throttle extensions, and in the IDLE SPEED CONTROL routine, as described below in reference to the flow diagrams of FIGS. 7 and 9, respectively. The RETRACT INHIBIT TIMER is used in the IDLE SPEED CONTROL routine, as described below in reference to the flow diagram of FIG. 9.

The block 160 determines the state of the NEG PR FLAG. If the NEG PR FLAG is not set, a feedforward throttle extension may be required to meet increased power steering loading. A routine for computing the positive feedforward motor pulse width (EXTEND LOGIC) is executed if the LOAD SWAP FLAG is not set, as determined at block 162, and the P/S ENABLE FLAG is set, as determined at block 164. The EXTEND LOGIC is depicted in detail in the flow diagram of FIG. 8, as indicated at the block 166. If the LOAD SWAP flag is set, feedforward retraction of the throttle setting is permitted unless the working pressure is greater than a reference, MAX PR, as determined at block 168. If NEW PR exceeds MAX PR, there is relatively high power steering loading, and the EXTEND LOGIC is executed to permit further throttle extension, so long as the P/S ENABLE FLAG is set. If the P/S ENABLE FLAG is not set, execution of the EXTEND LOGIC is skipped. If NEW PR is not in excess of MAX PR, a routine for computing a negative feedforward motor pulse width (RETRACT LOGIC) is executed. The RETRACT LOGIC is depicted in detail in the flow diagram of FIG. 7, as indicated at block 170.

If the NEG PR FLAG is set, the steering maneuver is over (or relaxed) and retraction of the feedforward throttle extension may be required to prevent engine speed flare. In such case, the blocks 172–174 are executed to update the total or accumulated amount of feedforward extension AE since the last retraction. This involves increasing the value of the term AE (up to a limit, AE MAX) by an amount AE′ corresponding to the extension actually delivered in the current steering maneuver. The development of the term AE′ is described below in reference to the EXTEND LOGIC of FIG. 8. Thereafter, the term AE′ is reset to zero, and the RETRACT LOGIC (block 170) is executed so long as NEW PR is not in excess of MAX PR. If NEW PR is in excess of MAX PR, there is relatively high power steering loading, and the EXTEND LOGIC is executed to permit further throttle extension so long as the P/S ENABLE FLAG is set.

Referring to FIG. 8, it will be seen that the EXTEND LOGIC operates to meter out the positive feedforward pulse width at a predetermined rate—that is, a predetermined maximum pulse width (12.5 ms) per loop. The maximum feedforward extension MAX EXT determined at blocks 114–116 of FIG. 4 may or may not be fully metered out, depending on the magnitude of MAX EXT and the duration of the steering maneuver.

The block 176 is first executed to determine the amount UE of undelivered feedforward throttle extension according to the difference (MAX EXT − AE′). If MAX EXT has been fully delivered, as determined at block 178, block 180 is executed to clear the EXT IN PROGRESS FLAG, indicating that a feedforward throttle extension is not in progress, and the remainder of the routine is skipped. If MAX EXT is not fully delivered, but is less than the maximum pulse width of 12.5 ms, as determined at block 182, block 184 is executed to set the extension command EXT CMD equal to UE. Otherwise, block 186 is executed to set the EXT CMD equal to the maximum pulse width of 12.5 ms. Thereafter, blocks 188–190 are executed to update the feedforward status terms and the accumulated extension term AE′. Specifically, the TIME SINCE LAST EXTEND CTR and the ISC RETRACT INHIBIT TIMER are reset, and the EXT IN PROGRESS FLAG is set. The term AE′ is updated by adding to it the extension command EXT CMD.

Referring to FIG. 7, it will be seen that the RETRACT LOGIC operates when enabled to at least partially retract feedforward throttle extensions that may have occurred since the last retraction. Such retractions are referred to as negative feedforward adjustments. As indicated at block 192, the retract command RET CMD is determined according to the product of the accumulated extensions since the last retraction AE and a RETRACT FACTOR F. The term AE is also reset to zero at this time. The RETRACT FACTOR F is scheduled as a function of the TIME SINCE LAST EXTEND CTR so that a relatively large retraction will be issued when the power steering load is increased and shortly thereafter decreased. Otherwise, little or no retraction will be issued, and the normal closed-loop IDLE SPEED CONTROL (described below in reference to FIG. 9), is relied on to remove the feedforward throttle extensions. This operation is graphically depicted in FIG. 2, as described below.

As with positive feedforward throttle adjustments, however, negative feedforward throttle adjustments can only occur if the vehicle speed $N_v$ is less than the reference speed REF $N_v$, as determined at block 194. If this condition is not met, the blocks 196 and 198 are executed to reset the retract command RET CMD to zero, and to clear the RET IN PROGRESS FLAG to indicate that a throttle retraction is not to be issued. If the vehicle speed condition is met, but the retract command is zero, as determined at block 200, the block 198 is still executed to clear the RET IN PROGRESS FLAG. Otherwise,the block 202 is executed to set the RET IN PROGRESS FLAG to indicate that a negative feedforward throttle adjustment is to be issued, and to reset the ISC RETRACT INHIBIT TIMER.

Figure 9:
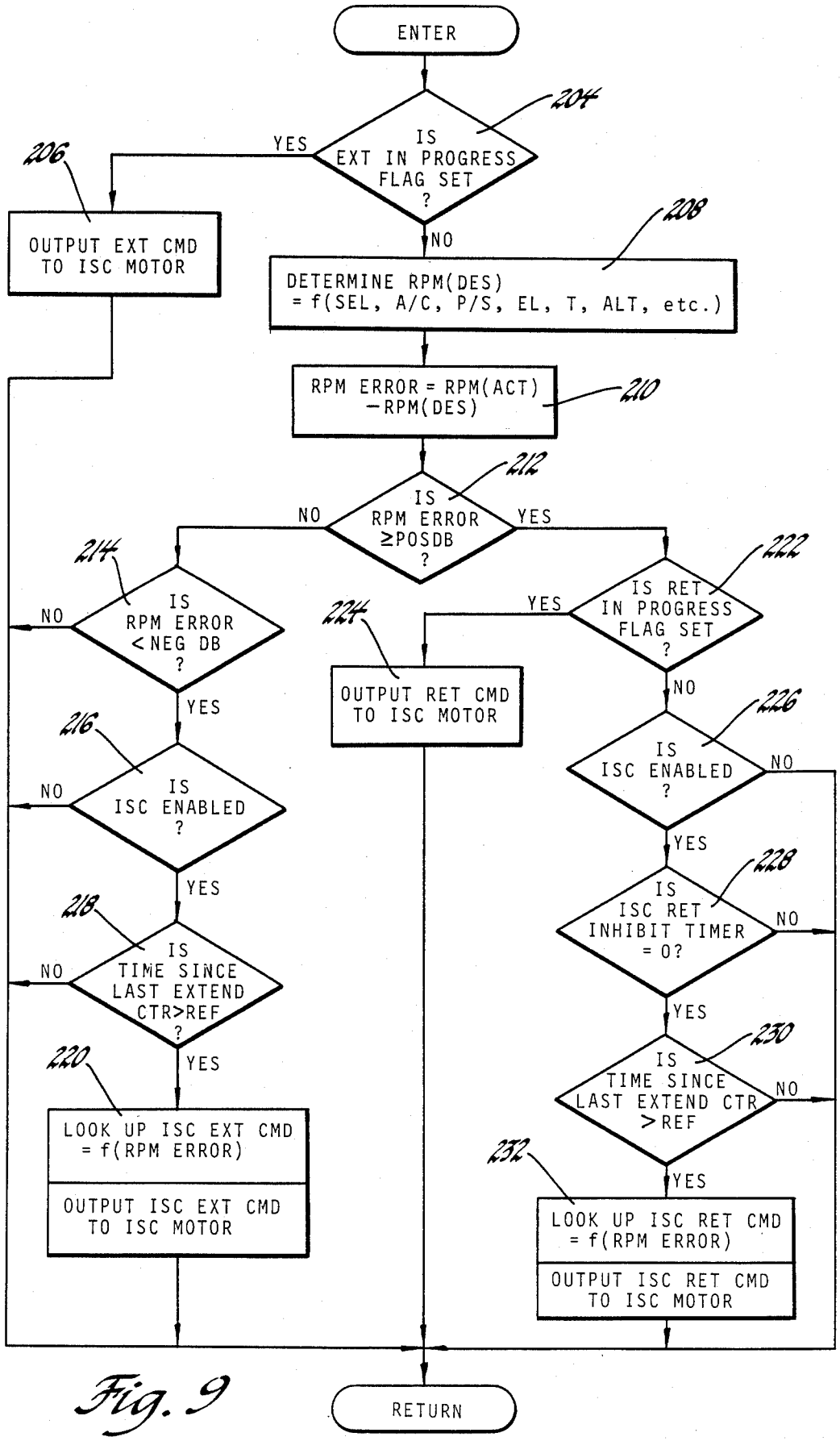

Referring to the flow diagram of FIG. 9, it will be seen that the IDLE SPEED CONTROL (ISC) routine operates to prioritize the issuance of feedforward and closed-loop adjustments to the ISC motor 48. Positive feedforward throttle adjustments have first priority; the feedforward extension command EXT CMD is issued immediately if the EXT IN PROGRESS FLAG is set, as indicated by the blocks 204–206. Otherwise, the blocks 208–210 are executed to determine a desired idle speed RPM(DES) and the speed error RPM ERROR between RPM(DES) and the measured, or actual, idle speed RPM(ACT). The desired idle speed is determined as a function of several parameters, including the transmission mode SEL, the air conditioning compressor clutch status A/C, the presence of relatively heavy power steering loading P/S, the presence of relatively heavy electrical loading EL, the coolant temperature T, the altitude ALT, etc.

Positive closed-loop throttle adjustments (ISC) have second priority. If RPM ERROR is less than a negative deadband threshold NEG DB, as determined at blocks 212–214, and the enable conditions defined by the blocks 216–218 are met, block 220 is executed to determine and issue an idle speed control extension command ISC EXT CMD. The block 216 determines if idle speed control is otherwise enabled and the block 218 determines if the count in the TIME SINCE LAST EXTEND CTR exceeds a reference count REF. If either of the conditions is not met, the execution of block 220 is skipped.

Negative feedforward throttle adjustments have third priority. If RPM ERROR is greater than a positive deadband threshold POS DB, as determined at block 212, blocks 222–224 are executed to issue the feedforward retract command RET CMD if the RET IN PROGRESS FLAG is set.

Negative closed-loop throttle adjustments (ISC) have last priority. If it is determined at block 222 that the RET IN PROGRESS FLAG is not set, and the enable conditions defined by the blocks 226–230 are met, block 232 is executed to determine and issue an idle speed control retraction command ISC RET CMD. The block 226 determines if idle speed control is otherwise enabled, block 228 determines if the ISC RETRACT INHIBIT TIMER has been decremented to zero, and block 230 determines if the TIME SINCE LAST EXTEND CTR is in excess of a reference threshold, REF. If any of the conditions are not met, the execution of block 232 is skipped.

Figure 10:
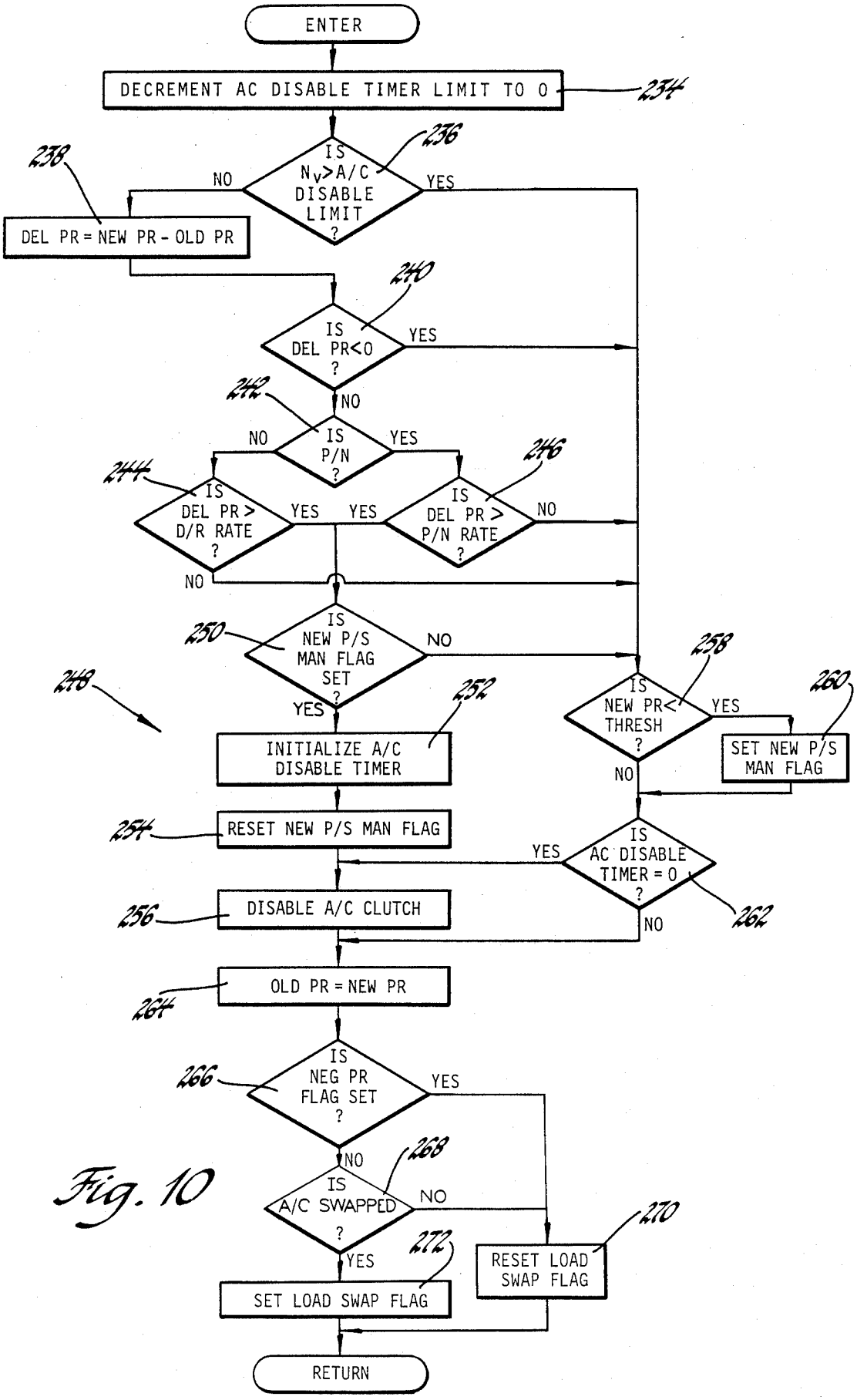

Referring to the flow diagram of FIG. 10, it will be seen that the A/C CLUTCH CONTROL routine operates to disallow engagement of the air conditioning compressor clutch 28 for a predetermined time in the presence of relatively high power steering loading and to indicate if a load swap occurred. Initially, the block 234 is executed to decrement the A/C DISABLE TIMER, limiting the timer value to zero. If the vehicle speed $N_v$ is not in excess of an A/C DISABLE LIMIT speed, as determined at block 236, the blocks 238–246 are executed to determine the rate of change in power steering working pressure DEL PR, and to compare that rate with a suitable reference rate (D/R RATE or P/N RATE) indicative of relatively heavy power steering load. The reference D/R RATE is used when the transmission 14 is in the Drive/Reverse range; the reference P/N RATE is used when the transmission 14 is in the Park/Neutral range. As indicated at block 238, the term DEL PR is determined according to the difference (NEW PR − OLD PR), where the term OLD PR designates the value that the term NEW PR had in the previous execution of the routine.

If the vehicle speed is less than the A/C DISABLE LIMIT, and the term DEL PR is greater than the respective reference rate D/R RATE or P/N RATE, energization of the air conditioning compressor clutch 28 should be disabled. Disengaging the clutch 28 under such conditions (load swap) immediately provides extra engine power output for driving the power steering load. Preventing clutch engagement under such conditions (no load swap) avoids engine stalling due to the increased load of the driving the compressor 24.

However, once the clutch 28 has been so disabled, further disables due to power steering pressure are not allowed unless NEW PR falls below a reference threshold THRESH, marking the end of a steering maneuver or a portion thereof. The flow diagram portion for implementing this criterion is designated by the reference numeral 248. A flag, designated NEW P/S MAN FLAG, indicates whether the clutch has been disabled in the current power steering maneuver. At the initiation of each period of vehicle operation, the NEW P/S MAN FLAG is set. At the first occurrence of the requisite pressure increase, block 250 is answered in the affirmative, and the blocks 252–256 are executed to initialize the A/C DISABLE TIMER, to reset the NEW P/S MAN FLAG, and to disable the A/C clutch. Thereafter, the NEW P/S MAN FLAG is only set if NEW PR falls below the threshold THRESH, as indicated at the blocks 258–260. Once the A/C DISABLE TIMER has been decremented to zero, as determined at block 262, the disable of the A/C clutch 28 is discontinued. In any event, the term OLD PR is then set equal to NEW PR, as indicated at block 264.

The blocks 266–272 serve to update the status of the LOAD SWAP FLAG. The LOAD SWAP FLAG is reset by block 270 to indicate no load swap if the NEG PR FLAG is set (block 266), or the A/C clutch 28 is already disengaged (A/C not swapped) (block 268). Otherwise, the block 272 is executed to set the LOAD SWAP FLAG to indicate that a load swap has occurred.

The operation of an idle speed control system according to this invention will now be described in relation to Graphs A–F of FIG. 2, which graphs are depicted on a common time base.

FIG. 2 illustrates both the steady state and transient response of the control system of this invention for three different types of steering maneuvers typically experienced in a motor vehicle. The different maneuvers are designated by the headings I, II and III. Graph A depicts the engine speed $N_e$ in RPM; Graph B depicts the power steering pressure P/S PRESSURE in $kP_a$; Graph C depicts the term START PR in $kP_a$; Graph D depicts the term POS DELTA in $kP_a$; Graph E depicts the throttle stop control; and Graph F depicts the angular position of engine throttle 40. In Graph E, the relatively short vertical lines designate the issuance of ISC motor control pulses by the idle speed control (ISC) routine, and the relatively tall pulses designate the issuance of ISC motor control pulses by the power steering feedforward (P/S) routine. Vertical lines above the time axis represent throttle stop extensions, and vertical lines below the time axis represent throttle stop retractions.

The steering maneuver I represents a slow to medium turning maneuver with sustained steering load. The power steering pressure depicted in Graph B is directly proportional to the amount of power steering assist and the load imposed on engine 12. Since the pressure rises progressively, the term START PR remains at the pressure in effect prior to the steering maneuver. The positive delta term POS DELTA thus follows the pressure curve of Graph B and results in the generation of positive feedforward adjustment of throttle 40, as indicated in Graphs E & F. This opens the throttle setting for generating increased engine power output to compensate for the power steering load.

At the same time, the desired speed of the idle speed control system is increased due to the presence of power steering load. If the positive feedforward throttle adjustment causes the engine speed to exceed the new desired engine speed, the idle speed control routine may issue one or more throttle retraction pulses to the ISC motor as indicated in Graph E. Since the steering load is sustained for a relatively long interval, the power steering feedforward routine does not issue a negative feedforward throttle adjustment at the termination of the maneuver. Instead, the idle speed is returned to the desired value by the issuance of negative closed-loop pulses by the idle speed control (ISC) routine as indicated in Graph E. At the termination of the steering maneuver, the start pressure START PR (Graph C) is initialized at the current level of the working pressure (Graph B), and then tracks it to a new steady state value. This resets the term POS DELTA to zero.

The steering maneuver II represents a power steering load increase from an initial partially loaded condition. The positive delta term POS DELTA is based on the updated start pressure term START PR and thus follows the increase in the working pressure as depicted in Graph D. As in the steering maneuver I, the increased load level results in the issuance of positive feedforward throttle adjustment as indicated in Graph E for increasing the engine power output to meet the increased engine load. Also, as in steering maneuver I, the steering load is sustained for a relatively long interval, and the idle speed is corrected at the termination of the maneuver solely by the idle speed control (ISC) routine. This operation is depicted in Graph E. At the termination of the maneuver, the start pressure term START PR is reset to the released level as indicated in Graph C resulting in a reset of the positive delta term POS DELTA as indicated in Graph D.

The steering maneuver III represents a relatively short duration application of power steering load. As with the maneuvers I and II, positive feedforward throttle adjustment is issued as indicated in Graph E to provide increased engine power output. However, the power steering feedforward routine issues negative throttle adjustments at the termination of the maneuver due to the short duration of the maneuver. The negative feedforward pulses have a magnitude determined according to the product of the total positive feedforward throttle adjustment and a factor determined as a function of the time elapsed since the positive feedforward pulses were issued. The negative feedforward throttle pulses prevent excessive creep when the driver twitches the hand wheel or when the vehicle wheel momentarily encounters an obstruction which loads the steering system.

Although the operation of the air conditioning compressor is not depicted in FIG. 2, it will be understood that the power steering maneuvers may result in a disable of the compressor clutch. If the compressor clutch is engaged when a disable occurs, there is a load swap of the air conditioning load for the power steering load and the positive feedforward throttle adjustments are inhibited.

While this invention has been described in reference to the illustrated embodiment, it is expected that various modifications thereto will occur to those skilled in the art. For example, an idle air bypass arrangement could be substituted for the throttle stop arrangement depicted in FIG. 1. Moreover, the invention equally applies to a vehicle having drive-by-wire throttle controls. If the vehicle has a variable displacement A/C compressor, the load swap effect will vary in relation to the compressor displacement, and feedforward throttle extension may be required in addition to the load swap in order to meet the power steering load requirements. It will be understood that feedforward systems incorporating these or other modifications may fall within the scope of this invention, which is defined by the appended claims.

The embodiments of the invention in which an exclusive property or privilege is claimed are defined as follows:

1. In a motor vehicle including an engine for supplying the input power requirement of a power assist steering system which develops a working pressure in relation to the level of steering assist demanded by the operator of the vehicle, where the engine power output under idle conditions is governed by the setting of an adjustable engine power control mechanism, an engine idle speed control system comprising:

closed loop idle speed control means for effecting relatively slow adjustment of the engine power control mechanism in relation to the difference between the actual engine idle speed and a desired engine idle speed value so as to bring the actual idle speed into substantial correspondence with the desired idle speed, the adjustment rate being chosen to provide control stability under steady state engine idle conditions; and feedforward idle speed control means for effecting relatively fast adjustment of the engine power control mechanism in response to changes in the input power requirement of the power assist steering system, the feedforward idle speed control means being effective:

(A) when the working pressure of the steering system is increasing (1) to detect the amount of pressure increase as an indication of the increase in the input power requirement of the steering system, (2) to determine a maximum adjustment value for said engine power control mechanism in relation to the detected pressure increase, (3) to effect open loop adjustment of the engine power control mechanism for increasing its setting by said maximum adjustment value, the rate of such open loop adjustment being limited by a maximum adjustment rate which avoids engine stalling while minimizing overshoot of the desired engine idle speed; and (B) when the working pressure of the steering system is decreasing to (1) detect the amount of pressure decrease as an indication of the decrease in the input power requirement of the steering system, and (2) interrupt the open loop adjustment of the engine power control mechanism as soon as the detected pressure decrease exceeds a reference pressure change indicative of a substantial reduction in the input power requirement of the steering system, thereby to avoid unnecessary overshoot of the desired engine idle speed upon completion of a steering maneuver.

2. The idle speed control system set forth in claim 1, wherein:

the open loop adjustment of the engine power control mechanism is given priority over the closed loop adjustment, and closed loop adjustment of the engine power control mechanism is inhibited for a predetermined interval of time following an open loop adjustment of the engine power control means.

3. The idle speed control system set forth in claim 1, where the motor vehicle engine additionally supplies the input power requirement of an intermittently activated load, the idle speed control system including:

load control means for disallowing activation of the the intermittently activated load for a predetermined interval of time when the working pressure of the power assist steering system increases at a rate in excess of a relatively high reference rate, and for inhibiting open loop adjustment of the engine power control means by said feedforward idle speed control means when such disallowing results in deactivation of said intermittently activated load.

4. In a motor vehicle including an engine for supplying the input power requirement of a power assist steering system which develops a working pressure in relation to the level of steering assist demanded by the operator of the vehicle, where the engine power output under idle conditions is governed by the setting of an adjustable engine power control mechanism, an engine idle speed control system comprising:

closed loop idle speed control means for effecting relatively slow adjustment of the engine power control mechanism in a positive or a negative sense in relation to the difference between the actual engine idle speed and a desired engine idle speed value so as to bring the actual idle speed into substantial correspondence with the desired idle speed, the adjustment rate being chosen to provide control stability under steady state engine idle conditions; and feedforward idle speed control means for effecting relatively fast adjustment of the engine power control mechanism in response to changes in the input power requirement of the power assist steering system, the feedforward idle speed control means being effective:

(A) when the working pressure of the steering system is increasing for (1) detecting the amount of pressure increase as an indication of the increase in the input power requirement of the steering system, (2) determining a maximum adjustment value for said engine power control mechanism in relation to the detected pressure increase, (3) effecting a positive open loop adjustment of the engine power control mechanism setting by said maximum adjustment value for increasing the engine power output to match the increased input power requirement of the steering system, the rate of such adjustment being limited by a maximum adjustment rate which avoids engine stalling while minimizing overshoot of the desired engine idle speed; and (B) when the working pressure of the steering system is decreasing for (1) interrupting the positive open loop adjustment of the engine power control mechanism setting as soon as the pressure decrease exceeds a reference pressure change indicative of a substantial reduction in the input power requirement of the steering system, and (2) effecting a negative open loop adjustment of the engine power control mechanism setting by an amount determined as a direct function of the cumulative amount of positive open loop adjustment carried out during the steering maneuver for quickly reducing the engine power output upon completion of the steering maneuver.

5. The idle speed control system set forth in claim 4, wherein:

the amount of negative open loop adjustment is further determined as an inverse function of the amount of time elapsed since the last occurrence of a positive open loop adjustment, so that in normal duration steering maneuvers, the positive open loop adjustments are relatively slowly removed by the closed loop idle speed control means, while in relatively short duration steering maneuvers, the positive open loop adjustments are relatively quickly removed by negative open loop adjustment.

6. The idle speed control system set forth in claim 4, where the motor vehicle engine additionally supplies the input power requirement of an intermittently activated load, the idle speed control system including:

load control means for disallowing activation of the intermittently activated load for a predetermined interval of time when the working pressure of the power assist steering system increases at a rate in excess of a relatively high reference rate, the feedforward idle speed control means being effective when such disallowing results in deactivation of said intermittently activated load to (1) inhibit positive open loop adjustment of the engine power control mechanism during such interval, and to (2) permit negative open loop adjustment of the engine power control mechanism in relation to the cumulative amount of positive open loop adjustment carried out during the steering maneuver and the amount of time elapsed since the last occurrence of a positive open loop adjustment.

7. The idle speed control system set forth in claim 4, wherein:

the positive open loop adjustment of the engine power control mechanism is given priority over closed loop adjustment, and closed loop adjustment of the engine power control mechanism is inhibited for a predetermined interval of time following a positive open loop adjustment of the engine power control means.

8. The idle speed control system set forth in claim 4, wherein:

positive open loop adjustment of the engine power control mechanism is given highest priority, positive closed loop adjustment of the engine power control mechanism is given second highest priority, negative open loop adjustment of the engine power control mechanism is given third highest priority, and negative closed loop adjustment of the engine power control mechanism given lowest priority.

9. In a motor vehicle including an engine for supplying the input power requirement of a power assist steering system which develops a working pressure in relation to the level of steering assist demanded by the operator of the vehicle, where the engine power output under idle conditions is governed by the setting of an adjustable engine power control mechanism, an engine idle speed control system comprising:

closed loop idle speed control means for effecting relatively slow adjustment of the engine power control mechanism in relation to the difference between the actual engine idle speed and a desired engine idle speed value so as to bring the actual idle speed into substantial correspondence with the desired idle speed, the adjustment rate being chosen to provide control stability under steady state engine idle conditions; and feedforward idle speed control means for effecting relatively fast adjustment of the engine power control mechanism in response to changes in the input power requirement of the power assist steering system, the feedforward idle speed control means being effective:

(A) when the working pressure of the steering system is increasing for (1) detecting the amount of pressure increase as an indication of the increase in the input power requirement of the steering system, and determining a maximum adjustment value for said engine power control mechanism in relation to such detected pressure increase, (2) effecting open loop adjustment of the engine power control mechanism setting for increasing its setting by said maximum adjustment value, at a rate of less than a maximum adjustment rate chosen for avoiding engine stalling while minimizing overshoot of the desired engine idle speed, (3) inhibiting open loop adjustment of the engine power control mechanism setting when the cumulative open loop adjustment effected during the steering maneuver reaches said maximum adjustment value; and (B) when the working pressure of the steering system is decreasing for (1) detecting the amount of pressure decrease as an indication of the decrease in the input power requirement of said steering system, and (2) interrupting the open loop adjustment of the engine power control mechanism as soon as the detected pressure decrease exceeds a reference pressure change indicative of a substantial reduction in the amount of engine output power required by the steering assist system, thereby to avoid unnecessary overshoot of the desired engine speed upon completion of a steering maneuver.

10. In a motor vehicle including an engine for supplying the input power requirement of a power assist steering system which develops a working pressure in relation to the level of steering assist demanded by the operator of the vehicle, where the engine power output under idle conditions is governed by the setting of an adjustable engine power control mechanism, an engine idle speed control system comprising:

closed loop idle speed control means for effecting relatively slow adjustment of the engine power control mechanism in relation to the difference between the actual engine idle speed and a desired engine idle speed value so as to bring the actual idle speed into substantial correspondence with the desired idle speed, the adjustment rate being chosen to provide control stability under steady state engine idle conditions; and feedforward idle speed control means for effecting relatively fast adjustment of the engine power control mechanism in response to changes in the input power requirement of the power assist steering system, the feedforward idle speed control means being effective:

(A) when the working pressure of the steering system is increasing for (1) detecting the amount of pressure increase as an indication of the increase in the input power requirement of the steering system, and determining a maximum adjustment value for said engine power control mechanism in relation to the detected pressure increase, (2) effecting positive open loop adjustment of the engine power control mechanism for increasing its setting by said maximum adjustment value, the rate of such adjustment being limited by a maximum adjustment rate chosen to avoid engine stalling while minimizing overshoot of the desired engine idle speed, (3) inhibiting open loop adjustment of the engine power control mechanism setting when the cumulative open loop adjustment effected during the steering maneuver reaches said maximum adjustment value; and (B) when the working pressure of the steering system is decreasing for (1) interrupting the positive open loop adjustment of the engine power control mechanism setting as soon as the pressure decrease exceeds a reference pressure change indicative of a substantial reduction in the input power requirement of the steering system, and (2) effecting a negative open loop adjustment of the engine power control mechanism setting by an amount determined as a direct function of the amount of positive open loop adjustment carried out during the steering maneuver for quickly reducing the engine power output upon completion of a steering maneuver.

* * * * *